US006394277B2

(12) United States Patent
Nickell et al.

(10) Patent No.: US 6,394,277 B2
(45) **Date of Patent: *May 28, 2002**

(54) OCTAGON SHAPED STACKABLE FLEXIBLE INTERMEDIATE BULK CONTAINER AND METHOD OF MANUFACTURE

(75) Inventors: Craig Alan Nickell, Sherman; Bobby Glenn Brown, Denison; Bradley Matthew Eisenbarth, Sherman, all of TX (US)

(73) Assignee: B.A.G. Corp., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/771,270

(22) Filed: Jan. 26, 2001

Related U.S. Application Data

(63) Continuation of application No. 09/515,631, filed on Feb. 29, 2000, now Pat. No. 6,244,443, which is a continuation-in-part of application No. 09/458,362, filed on Dec. 9, 1999, now Pat. No. 6,220,755, which is a continuation-in-part of application No. 09/390,403, filed on Sep. 3, 1999, now Pat. No. 6,203,198.

(51) Int. Cl.[7] ..... B65D 19/00

(52) U.S. Cl. ..... 206/600; 220/4.29; 220/9.4; 383/119

(58) Field of Search ..... 206/386, 600; 220/9.1–9.4, 4.28, 4.29, 6; 229/109, 110, 199, 122.21, 122.28; 383/104, 119; 493/59, 89

(56) References Cited

U.S. PATENT DOCUMENTS

| | | | | | |
|---|---|---|---|---|---|
| 4,903,859 | A | * | 2/1990 | Derby et al. | 206/600 |
| 5,323,922 | A | * | 6/1994 | Lapoint, Jr. et al. | 220/4.28 |
| 5,829,595 | A | * | 11/1998 | Brown et al. | 206/600 |
| 6,000,549 | A | * | 12/1999 | Perkins | 206/600 |

* cited by examiner

*Primary Examiner*—Luan K. Bui
(74) *Attorney, Agent, or Firm*—Michael A. O'Neil

(57) ABSTRACT

A bulk bag comprises eight substantially identical side wall portions each containing a stiffening panel. A bottom wall is connected to the bottom edges of the side wall portions and may be provided with a discharge port. Alternatively, a discharge port may be provided in one of the side wall portions. The bulk bag may be provided with a top wall which may be either openable or secured in place. A pallet and/or lift loops may be provided for transporting the bulk bag and the contents thereof.

1 Claim, 10 Drawing Sheets

Fig. 7
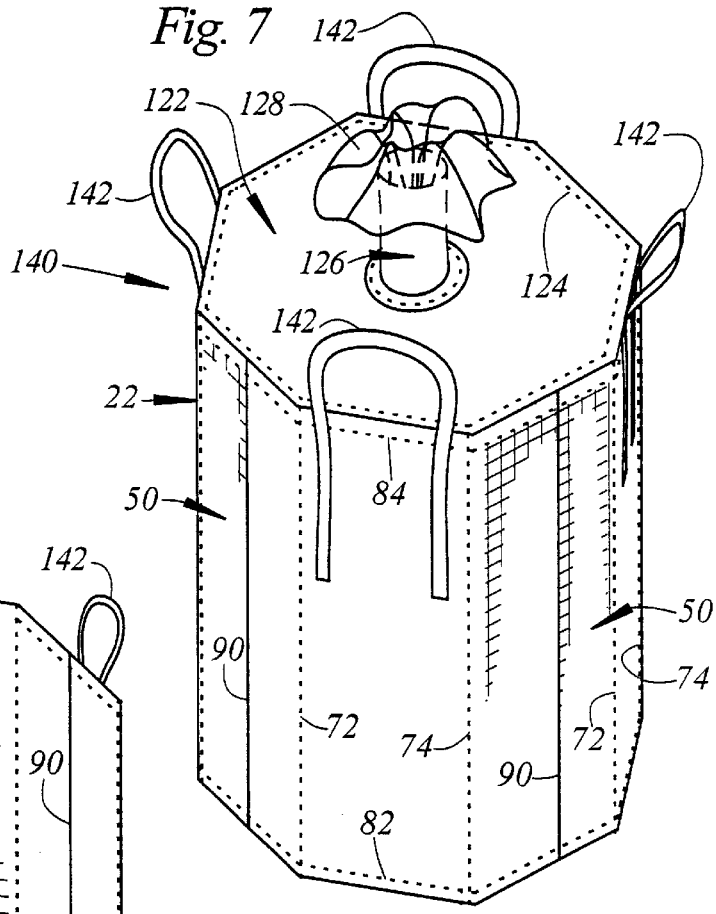
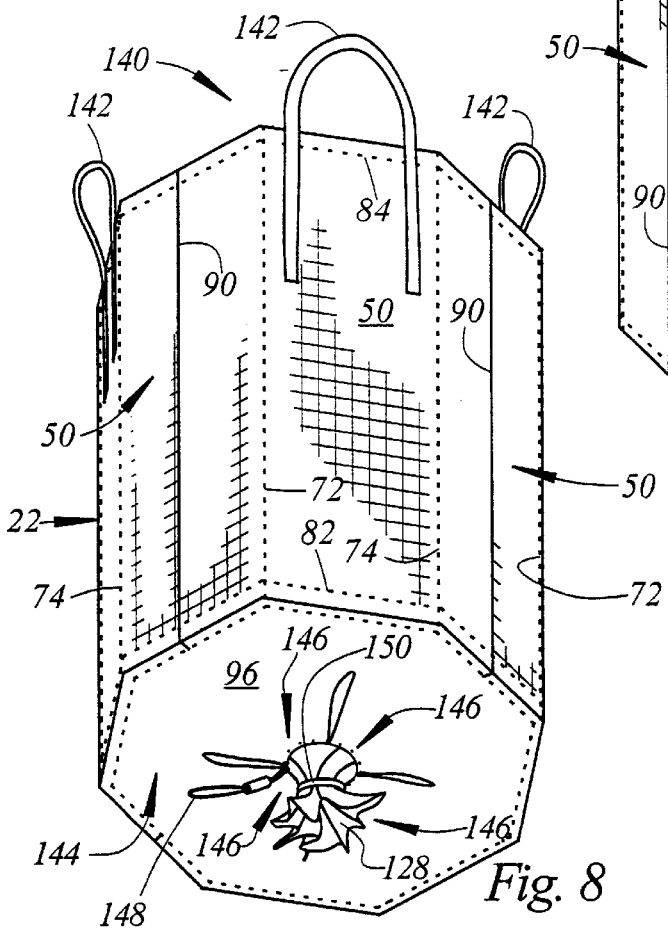
Fig. 8

OCTAGON SHAPED STACKABLE FLEXIBLE INTERMEDIATE BULK CONTAINER AND METHOD OF MANUFACTURE

CROSS-REFERENCE TO RELATED APPLICATIONS

This is a continuation application under 37 C.F.R. §1.63 of application Ser. No. 09/515,631 filed Feb. 29, 2000, now U.S. Pat. No. 6,244,443, which is a continuation-in-part of application Ser. No. 09/458,362 filed Dec. 9, 1999, now U.S. Pat. No. 6,220,755, which is a continuation-in-part of application Ser. No. 09/390,403 filed Sep. 3, 1999, now U.S. Pat. No. 6,203,198.

TECHNICAL FIELD

The present invention relates generally to flexible intermediate bulk containers, also known as bulk bags, and more particularly to octagon shaped bulk bags which are adapted for stacking one on top of another.

BACKGROUND AND SUMMARY OF THE INVENTION

Over the past thirty years flexible intermediate bulk containers, commonly known as bulk bags, have come into widespread use for receiving, storing, transporting, and discharging flowable materials of all types. Although circular bulk bags are known, bulk bags are typically constructed from rectangular panels which are sewn together along their adjacent edges to define a bulk bag which is initially square or rectangular in horizontal cross section. Nevertheless, all bulk bags, whether initially square, rectangular, or circular in cross section tend to assume a circular configuration when filled due to the uniform pressure imposed by the contents of the bulk bag against the flexible fabric side walls thereof.

U.S. Pat. No. 4,903,859 discloses a bulk bag comprising four double layer side walls. Stiffeners formed from cardboard are inserted between the layers of the side walls thereby imparting sufficient rigidity to the container to permit its use with liquids. Although the bulk bag of the '859 patent has been generally well received, its utilization has been somewhat limited by the fact that it cannot be stacked.

Co-pending application Ser. No. 09/390,403 assigned to the assignee hereof (doing business as Composite Container Corp.) discloses an improvement over the bulk bag of the '859 patent. In application Ser. No. 09/390,403 there is disclosed a bulk bag having double layer side walls and vertically extending corner the side walls and wooden posts are received in the corner pockets to provide a bulk bag suitable for use with liquids which is stackable.

U.S. Pat. No. 5,076,710 discloses a baffle-type bulk bag wherein bridge panels or baffles are sewn across the four corners of a nominally rectangular bulk bag. The baffles prevent the side walls of the bulk bags from bulging outwardly when the bulk bag is filled, thereby retaining the filled bulk bag in a more or less rectangular cross-sectional configuration. The baffles may be provided with apertures which allow material to flow into and out of the corners of the bulk bag during filling and discharging operations.

Co-pending application Ser. No. 09/458,362 also assigned to the assignee hereof discloses a baffle-type bulk bag which is stackable. In the bulk bag of application Ser. No. 09/458,362, triangular stiffeners are provided in the triangular corners of baffle-type bulk bags. The stiffeners may be formed from various materials including plastic panels, panels formed from corrugated paperboard and similar materials, etc. The stiffeners may be provided with apertures aligned with the apertures of the baffles thereby permitting the flow of material into and out of the bulk bag during filling and discharging operations.

The present invention comprises an improvement over the bulk bags disclosed in the '859 and '710 patents and in the '403 and '362 patent applications which provides an octagon shaped bulk bag which is stackable. The use of the octagon shape in the construction of the bulk bag is advantageous in that it provides maximum stackability while eliminating the need for baffles and triangular stiffeners contained within the baffles.

In accordance with the broader aspects of the invention, there is provided a bulk bag comprising eight double layer side wall portions. Each double layer side wall portion receives a stiffening panel which extends substantially the entire length and width of the side wall portion. The stiffening panels used in the side wall portions of the bulk bag of the present invention may comprise corrugated plastic panels or similar panels made from other materials which are sufficiently resistant to bending.

The octagon shaped bulk bags of the present invention are adapted for mounting on pallets. The bulk bag may also be provided with lift loops. The bulk bags of the present invention have bottom walls which may include a discharge port. Alternatively, one of the side wall panels may be provided with a discharge port located at the lower end thereof. The bulk bags of the present invention may have an open top, or a suitable top closure may be provided. Suitable top closures useful in the practice of the invention include openable flexible panels, openable rigid panels, and permanently mounted panels including fill spouts.

In accordance with another aspect of the invention, there is provided an eight piece bulk bag side wall construction. The eight pieces are arranged in four sets each comprising an inner layer and an outer layer. The inner and outer layers are joined together by vertically extending seams which are spaced apart by a distance equal to approximately ⅛ of the circumference of the bulk bag, thereby forming four of the side wall portions. The opposite edges of the inner and outer layers comprising the four side wall assemblies are joined edge to edge to form the remaining four side wall portions of the bulk bag. A stiffening panel is positioned between the inner and outer layers of each side wall portion and at least the bottom edges of the side wall sections are sewn together to secure the stiffening panels therein.

BRIEF DESCRIPTION OF THE DRAWINGS

A more complete understanding of the invention may be had by reference to the following Detailed Description, when taken in conjunction with the accompanying Drawings, wherein:

FIG. 7 is a top perspective view illustrating a second variation of the bulk bag of FIG. 1;

FIG. 8 is a bottom perspective view of the bulk bag of FIG. 7;

DETAILED DESCRIPTION

Figure 1:
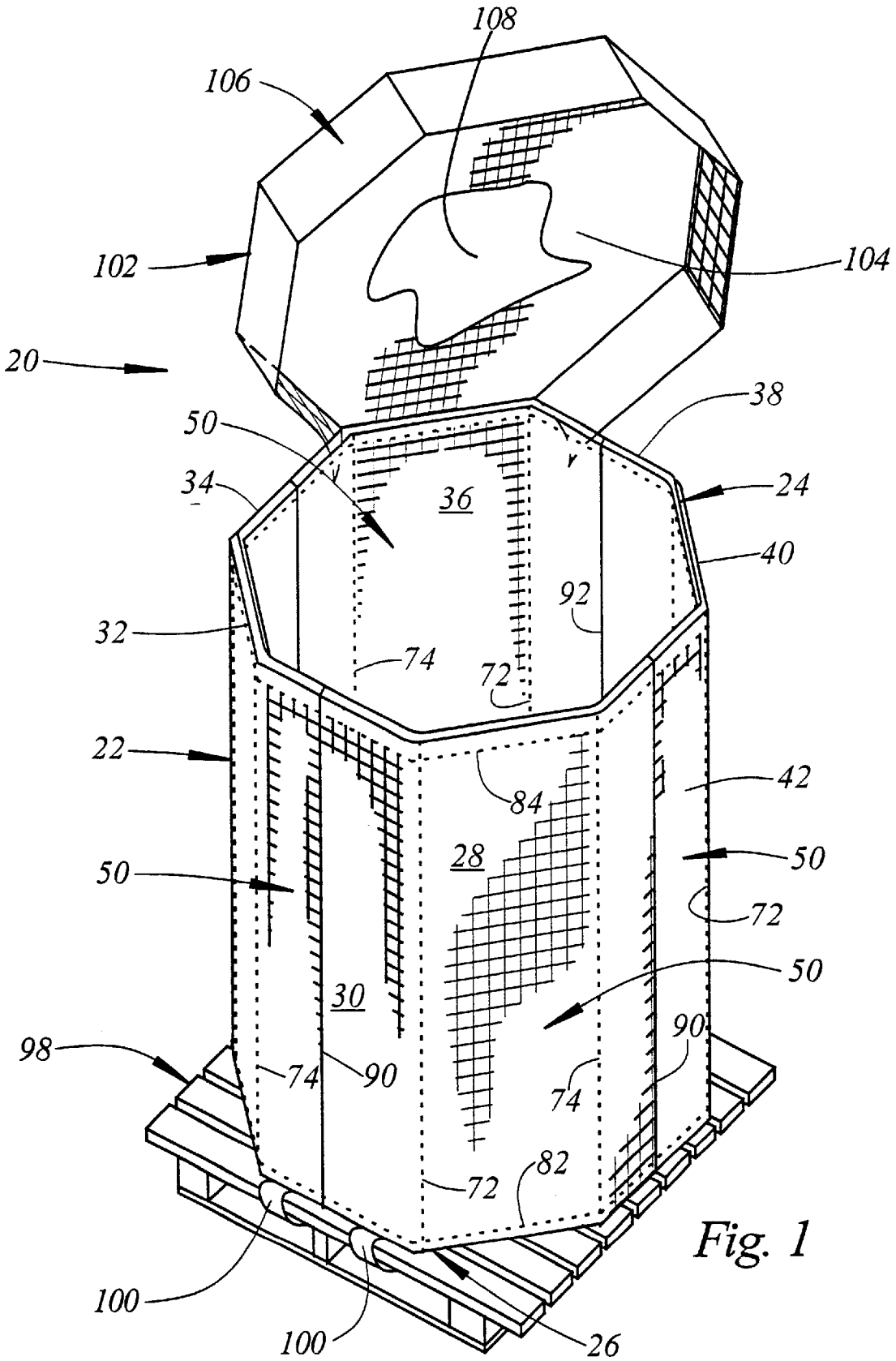
FIG. 1 is a perspective view of an octagon shaped bulk bag incorporated in the present invention.

Referring now to the Drawings, and particularly to FIG. 1 thereof, there is shown an octagon shaped bulk bag 20 comprised in the present invention. The octagon shaped bulk bag 20 is characterized by an octagonal side wall 22 having a top or upper edge 24 and a bottom or lower edge 26. The octagonal side wall 22 comprises eight substantially identical side wall portions 28, 30, 32, 34, 36, 38, 40, and 42. The side wall portions 28–42, inclusive, are connected edge to edge to form the octagonal side wall 22.

Figure 2:
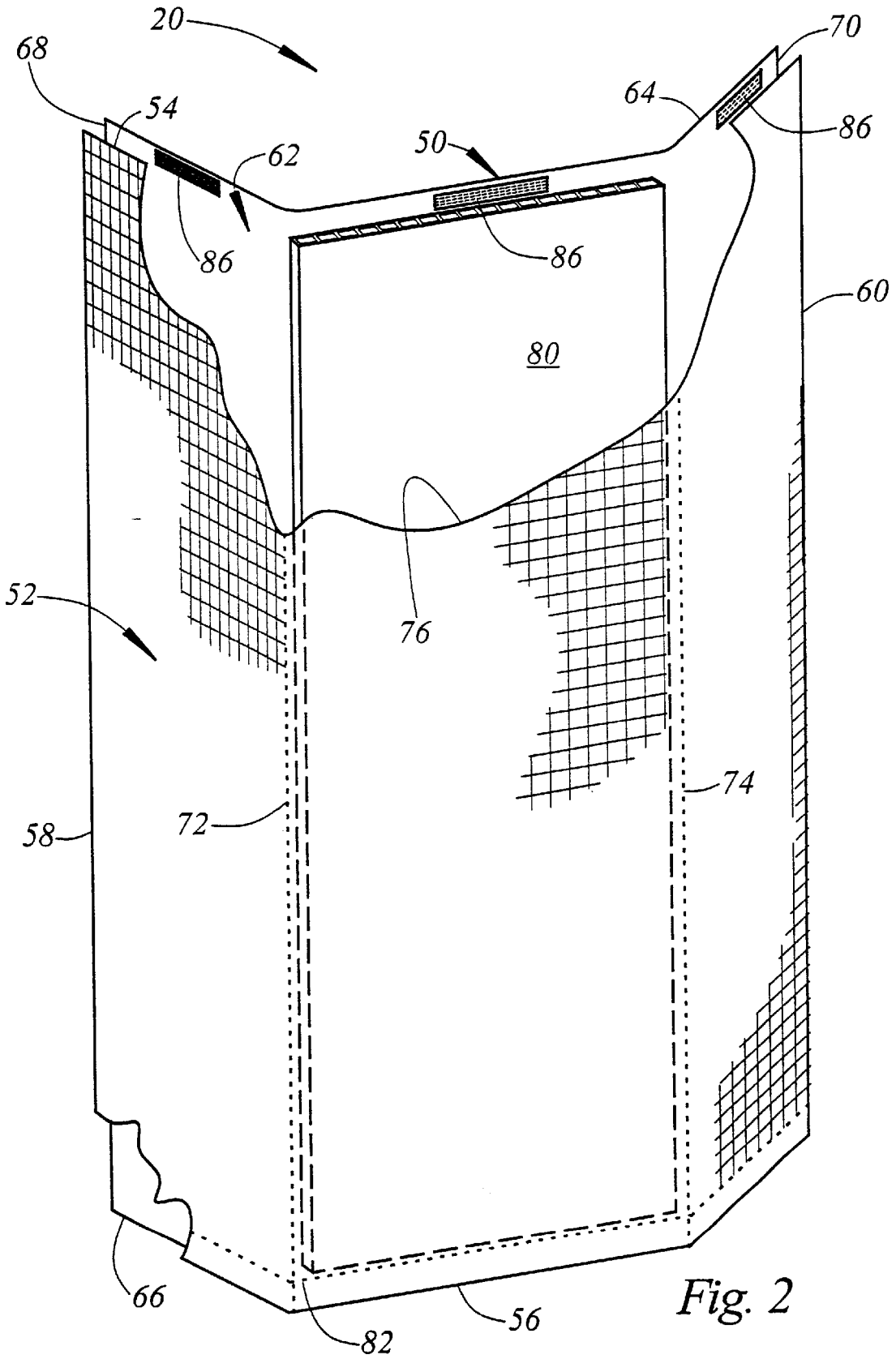
FIG. 2 is a perspective view of a side wall assembly useful in the practice of the invention.

As is best shown in FIG. 2, the octagonal side wall 22 of the bulk bag 20 comprises four substantially identical side wall assemblies 50. Each side wall assembly 50 comprises an outer layer 52 having a top or upper edge 54, a bottom or lower edge 56, and opposed side edges 58 and 60. The side wall assembly 50 further comprises an inner layer 62 having a top or upper edge 64, a bottom or lower edge 66, and opposed side edges 68 and 70. Each side wall assembly 50 comprising the bulk bag 20 is further characterized by a predetermined length, which is the vertical dimension, and a predetermined width, which is the horizontal dimension. The layers 52 and 62 are preferably formed from woven polypropylene fabric; however, other materials may also be used in the practice of the invention.

The outer layer 52 and the inner layer 62 comprising the side wall assembly 50 are joined by spaced apart vertically disposed seams 72 and 74. The seams 72 and 74 of the side wall assemblies 50 define the side wall portions comprising the side wall 22 of the bulk bag 20. The seams 72 and 74 also define stiffening panel receiving pockets 76. Each stiffening panel receiving pocket 76 eventually receives a stiffening panel 80 therein. In the construction of the bulk bag 20, the stiffening panel receiving pockets 76 are closed at the bottom or lower ends thereof by a bottom seam 82.

The stiffening panels 80 of the present invention may be manufactured from plastic panels of the type sold by Coroplast of Dallas, Tex., under the trademark COREX™. Other types of plastic panels may also be used, depending upon the requirements of particular applications of the invention. The stiffening panels 80 may also be formed from various types of paperboard; fiberboard, including medium density fiberboard (MDF); cardboard; plywood; and other materials depending upon the ability of stiffening panels formed from such materials to resist bending.

Referring simultaneously to FIGS. 1 and 2, the top or upper end of each stiffening panel receiving pocket 76 and the top or upper edges of the outer and inner layers 52 and 62 may be permanently joined by a seam 84. Alternatively, the top or upper ends of the stiffening panel receiving pockets 76 may be releaseably closed by fastening mechanisms 86 which may comprise hook-and-loop fasteners of the type sold under the trademark VELCRO®, buttons, or snaps. The use of the releaseable fasteners 86 allows the stiffening panels 80 to be removed from the stiffening panel receiving pockets 76 to facilitate folding of the bulk bag 20 for transportation and storage.

Figure 3:
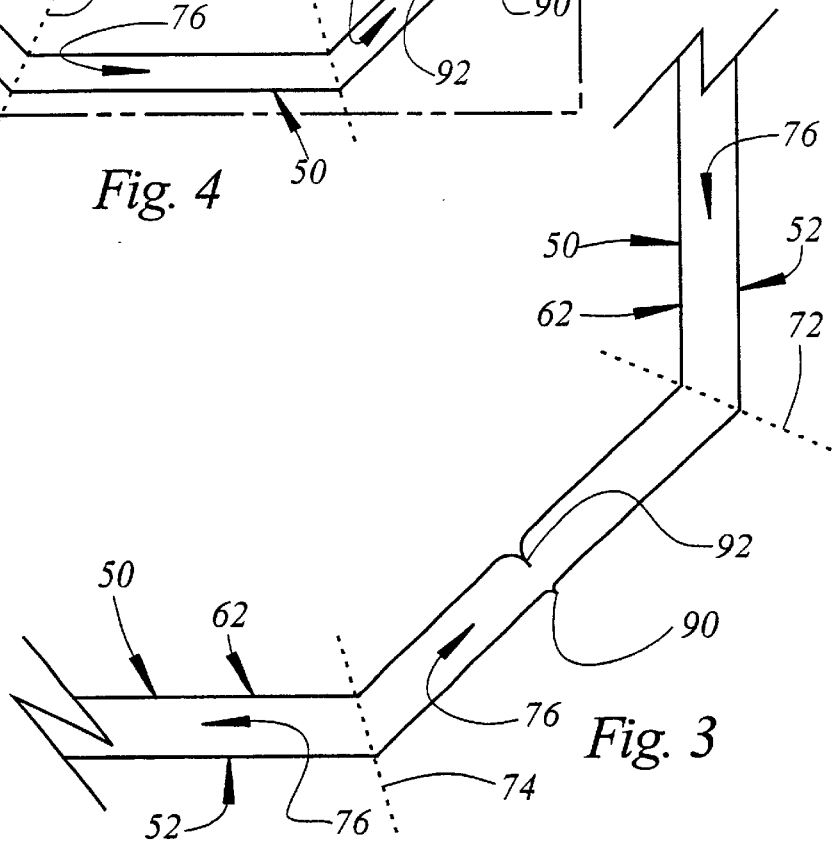
FIG. 3 is an enlarged partial top view of the octagon shaped bulk bag of FIG. 1 illustrating the joinder of adjacent side wall assemblies.

In the construction of the bulk bag 20 the four side wall assemblies 50 are connected edge to edge to form the side wall 22. As is best shown in FIG. 3, the side edges 58 and 60 of adjacent side wall assemblies 50 are joined by seams 90. Likewise, the adjacent edges 68 and 70 of the inner layers 62 are joined by seams 92. As will be appreciated by those skilled in the art, the circumference defined by the joinder of the four inner layers 62 comprising the four side wall assemblies 50 must be somewhat less than the circumference defined by the four outer layers 52 in order to provide sufficient space between the outer layers 52 and the inner layers 62 to receive the stiffening panels 80. For this reason, the seams 92 which join the inner layers 62 consume somewhat more fabric when compared with the seams 90 which join the outer layers 52.

When the seams 90 and 92 are completed, the outwardly extending portions of the outer and inner layers 52 and 62 comprising the side wall assemblies 50 form stiffening panel receiving pockets 76. Thus, the completed side wall 22 includes eight stiffening panel receiving pockets 76, including the stiffening panel receiving pockets defined by the seams 72 and 74 of each side wall assembly 50 and the stiffening panel receiving pockets 76 which are formed when the seams 90 and 92 are completed.

Figure 4:
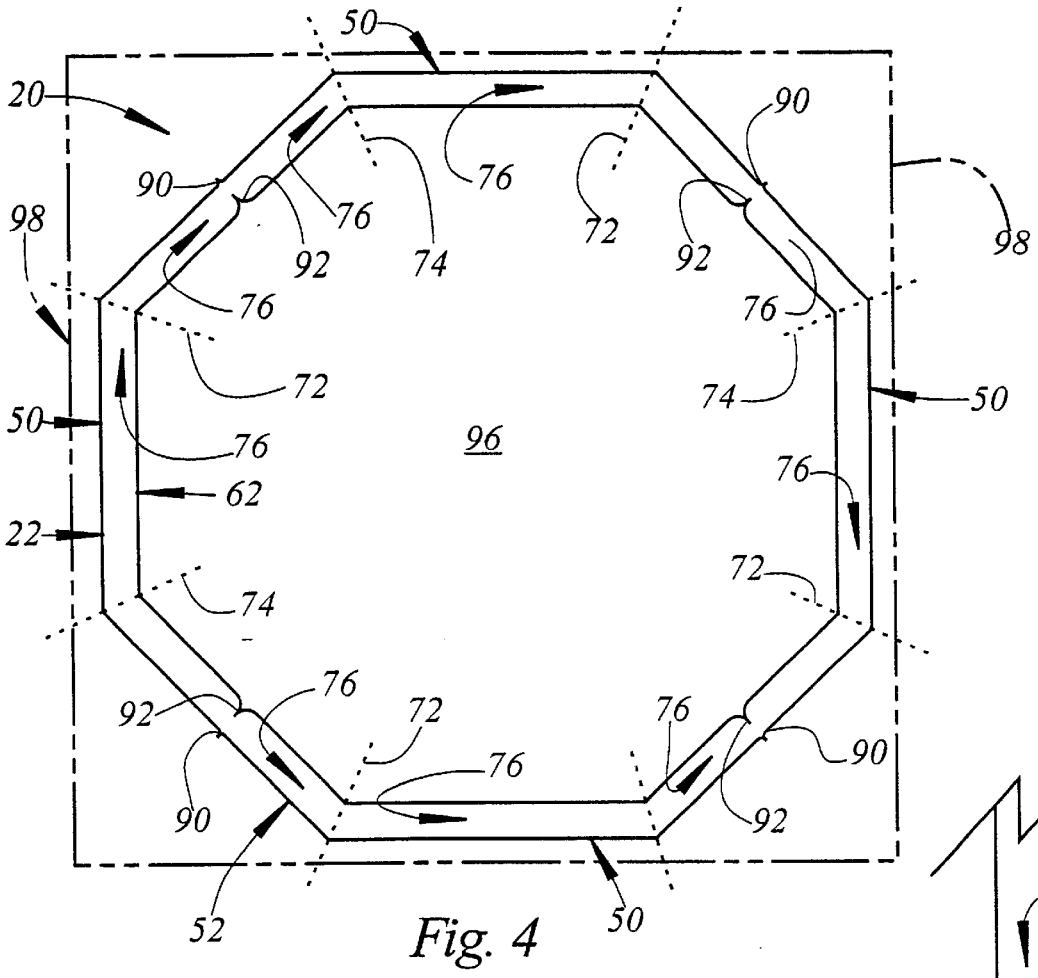
FIG. 4 is a top view of the octagon shaped bulk bag of FIG. 1.

Referring simultaneously to FIGS. 1 and 4, the bulk bag 20 includes an octagon shaped bottom wall 96 which is secured to the outer and inner layers 52 and 62 of the side wall assemblies 50 by the bottom seam 82. Like the other components of the bulk bag 20, the bottom wall 96 is preferably formed from polypropylene fabric. Other materials may be utilized in the construction of the bottom wall 96 and the other components of the bulk bag 20 depending upon the requirements of particular applications of the invention.

A pallet 98 may be employed to facilitate transportation and positioning of the bulk bag 20 and the contents thereof. In such instances, the bulk bag 20 is preferably provided with retaining members 100 which are extended around component parts of the pallet 98 to retain the bulk bag 20 in engagement therewith. Other mechanisms for securing the bulk bag 20 to the pallet 98 may be utilized in lieu of the retaining members 100 depending upon the requirements of particular applications of the invention.

The bulk bag 20 may be provided with a top or cover 102. If used, the top or cover 102 is preferably formed from woven polypropylene fabric, it being understood that other materials can be utilized in the construction of the top 102, if desired. The top 102 may be completely removable from the side wall 22 of the bulk bag 20. Alternatively, the top 102 may be hingedly secured to the side wall 22 by means of the top seam 84 situated at the top of the side wall 22.

The top 102 may comprise a cover panel 104 and a skirt 106 extending downwardly from the panel 104. The top 102 can be flexible or rigid, in which event a stiffening panel 108 is used. Conventional retaining apparatus may be utilized to secure the top 102 to the side wall 22 of the bulk bag 20, if desired.

Figure 5:
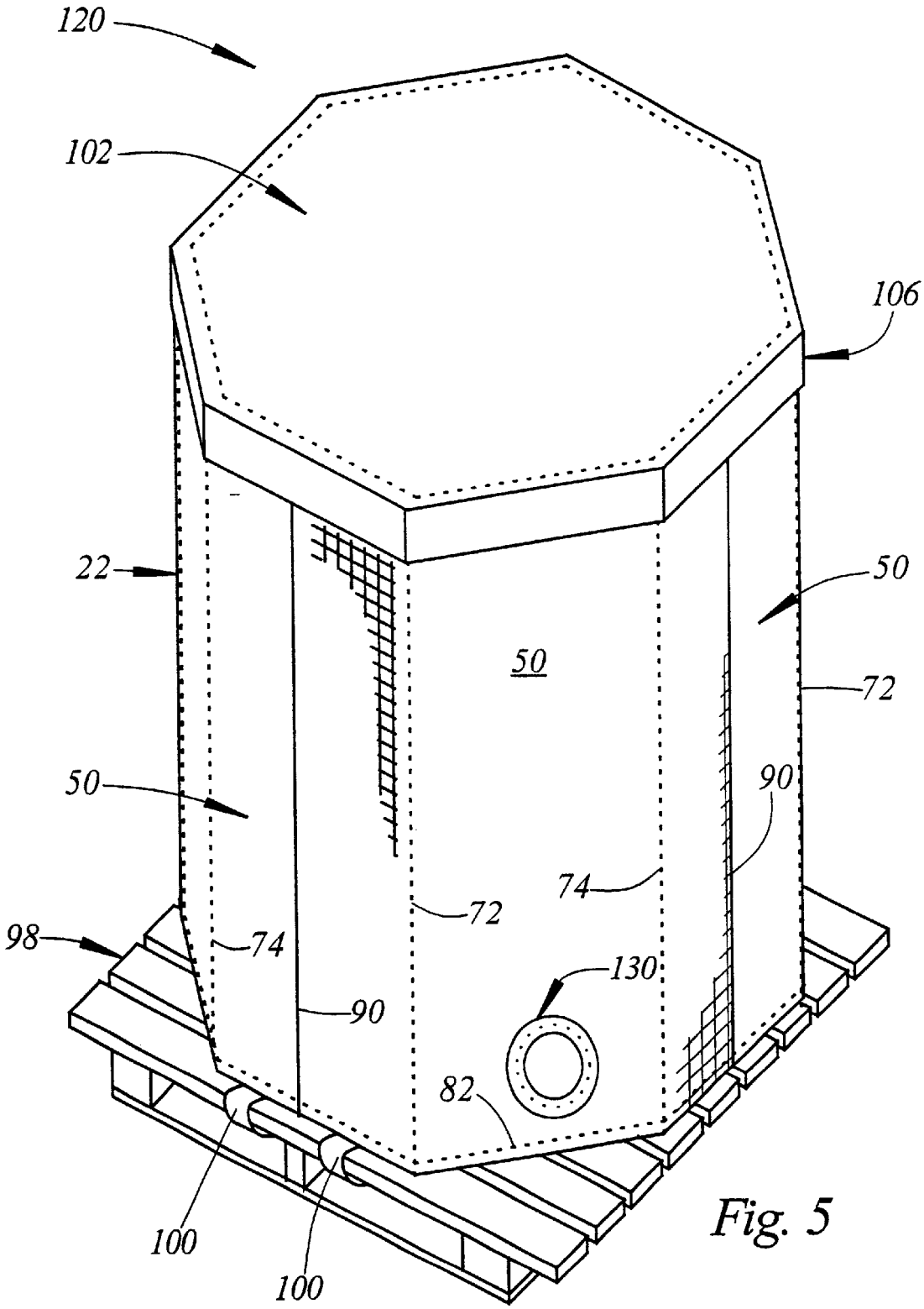
FIG. 5 is a perspective view illustrating a first variation of the octagon shaped bulk bag of FIG. 1.

In FIG. 5, there is shown a bulk bag 120 comprising a first variation of the bulk bag 20 illustrated in FIGS. 1–4, inclusive, and described hereandabove in conjunction therewith. Many of the component parts of the bulk bag 120 are identical in construction and function to component parts of the bulk bag 20. Such identical component parts are designated in FIG. 5 with the same reference numerals utilized above in the description of the bulk bag 20.

Bulk bags constructed in accordance with the present invention may be provided with conventional gland-type liners which facilitate the use of the bulk bag to receive, transport, discharge, and store liquids. The liner extends around the entire interior of the bulk bag 120 including the interior of the side wall 22, the bottom wall 96, and the top wall 102.

Bulk bags constructed in accordance with the present invention are adapted for use with a variety of discharge apparatus. The bulk bag 120 includes a discharge port 130 formed in one of the side wall portions comprising the side wall 22, it being understood that the discharge port 130 can also be positioned in the bottom wall of the bulk bag 120. The discharge port 130 extends through the side wall 22 and through the liner, thereby connecting the interior of the bulk bag 120 to the exterior thereof. Discharge ports of the type shown in FIG. 5 are particularly adapted for use in bulk bags designed to receive, transport, store, and discharge liquids.

Figure 6:
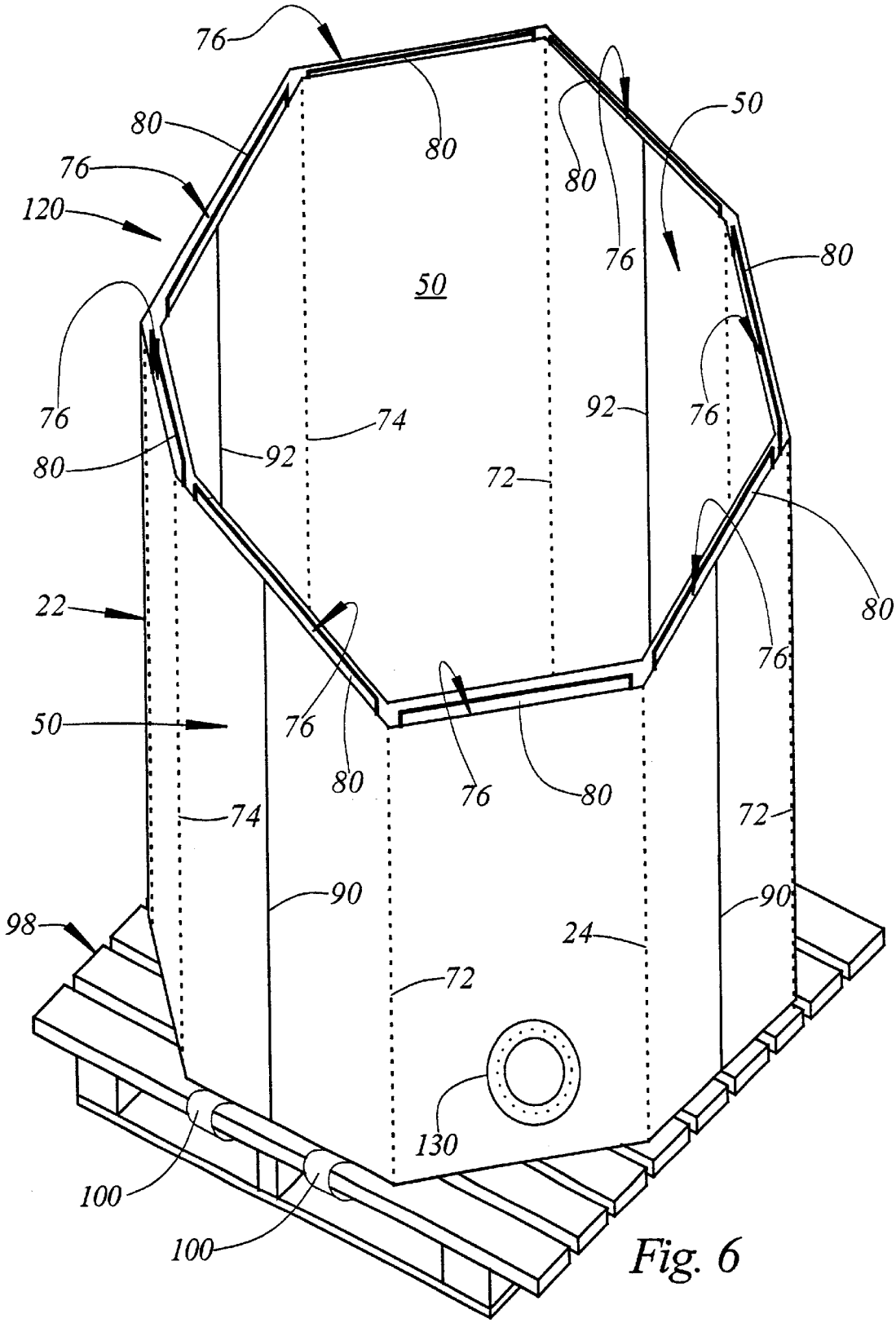
FIG. 6 is a view similar to FIG. 5 in which certain component parts are shown in section more clearly to illustrate certain features of the invention.

FIG. 6 comprises a horizontal sectional view taken through the upper portion of the bulk bag 120 of FIG. 5, it being understood that a similar horizontal section view taken through the upper portion of the bulk bag 20 of FIG. 1 would be, in all practical respects, identical. In FIG. 6 the eight stiffener panel receiving pockets 76 and the eight stiffener panels 80 received therein are illustrated.

Figure 9:
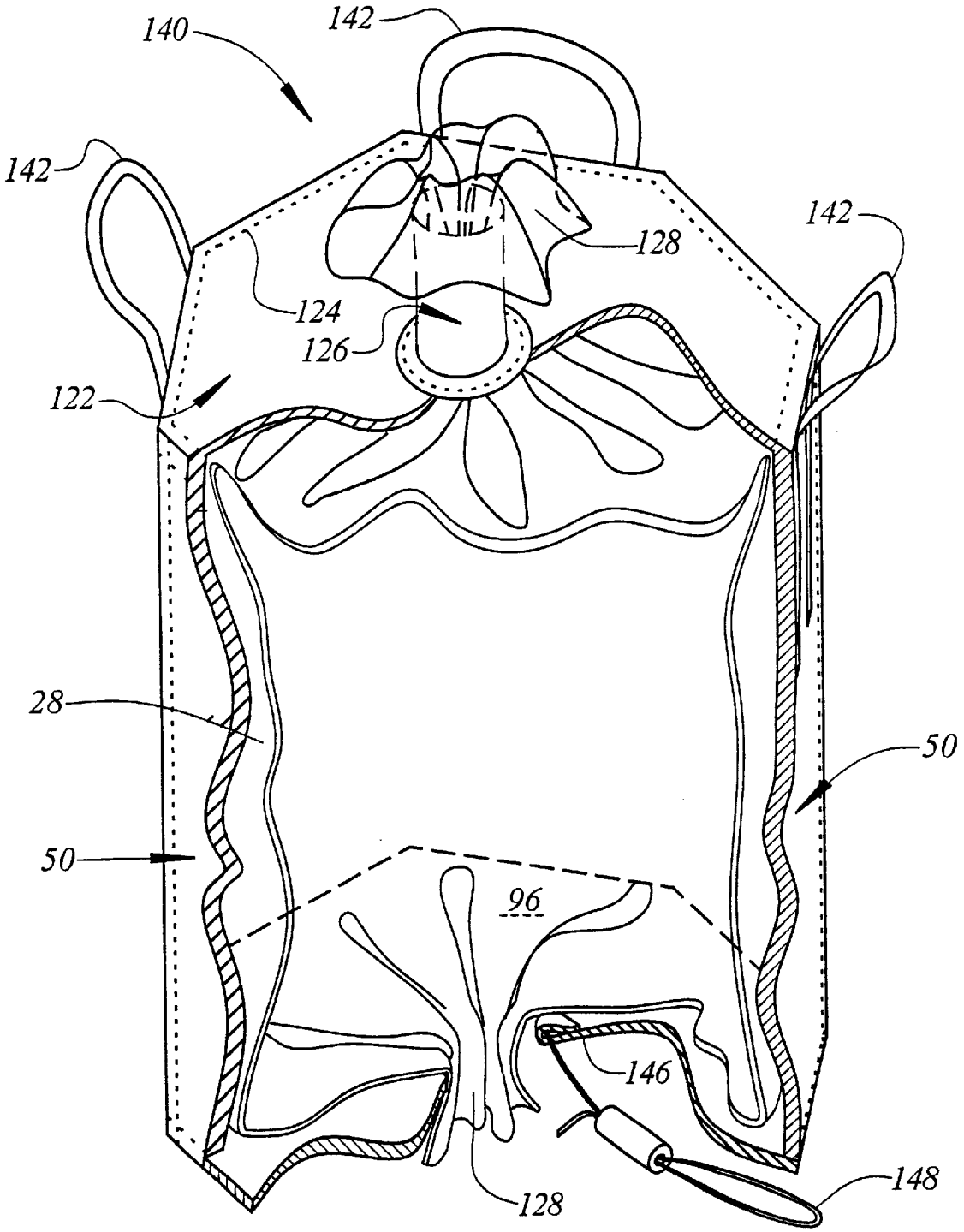
FIG. 9 is a sectional view of the bulk bag of FIG. 7 illustrating the use of liners in conjunction with bulk bags incorporating the invention.

FIGS. 7, 8, and 9 illustrate a bulk bag 140 comprising a second alternative version of the bulk bag 20 of FIG. 1. Many of the component parts of the bulk bag 140 are identical in construction and function to component parts of the bulk bag 20 illustrated in FIG. 1 and to component parts of the bulk bag 120 illustrated in FIG. 5. Such identical component parts are designated in FIGS. 7, 8, and 9 with the same reference numerals utilized in the foregoing description of the bulk bags 20 and 120.

The bulk bag 140 differs from the bulk bags 20 and 120 in that the bulk bag 140 is not mounted on a pallet. Rather, the bulk bag 140 is provided with lift loops 142 which are utilized in the transportation and positioning of the bulk bag 140. The lift loops 142 are preferably formed from nylon webbing and are conventional in design and function.

The bulk bag 120 differs from the bulk bag 20 in that it is provided with a permanently installed top 122 which is secured to the side wall 22 by a seam 124. As is conventional in bulk bag construction, the top 122 is provided with a fill spout 126.

The bulk bag 140 further differs from the bulk bags 20 and 120 in that the bulk bag 140 is provided with a discharge port 144 formed in the bottom wall 96. The discharge port 144 comprises four closure flaps 146 formed from the material of the bottom wall 96 and interconnected by a drawstring 148. A liner 128 extends through the discharge port 144 and may be provided with closure apparatus such as a tie-tie 150. Those skilled in the art will realize that the discharge port 144 is conventional in design and construction.

Figure 10:
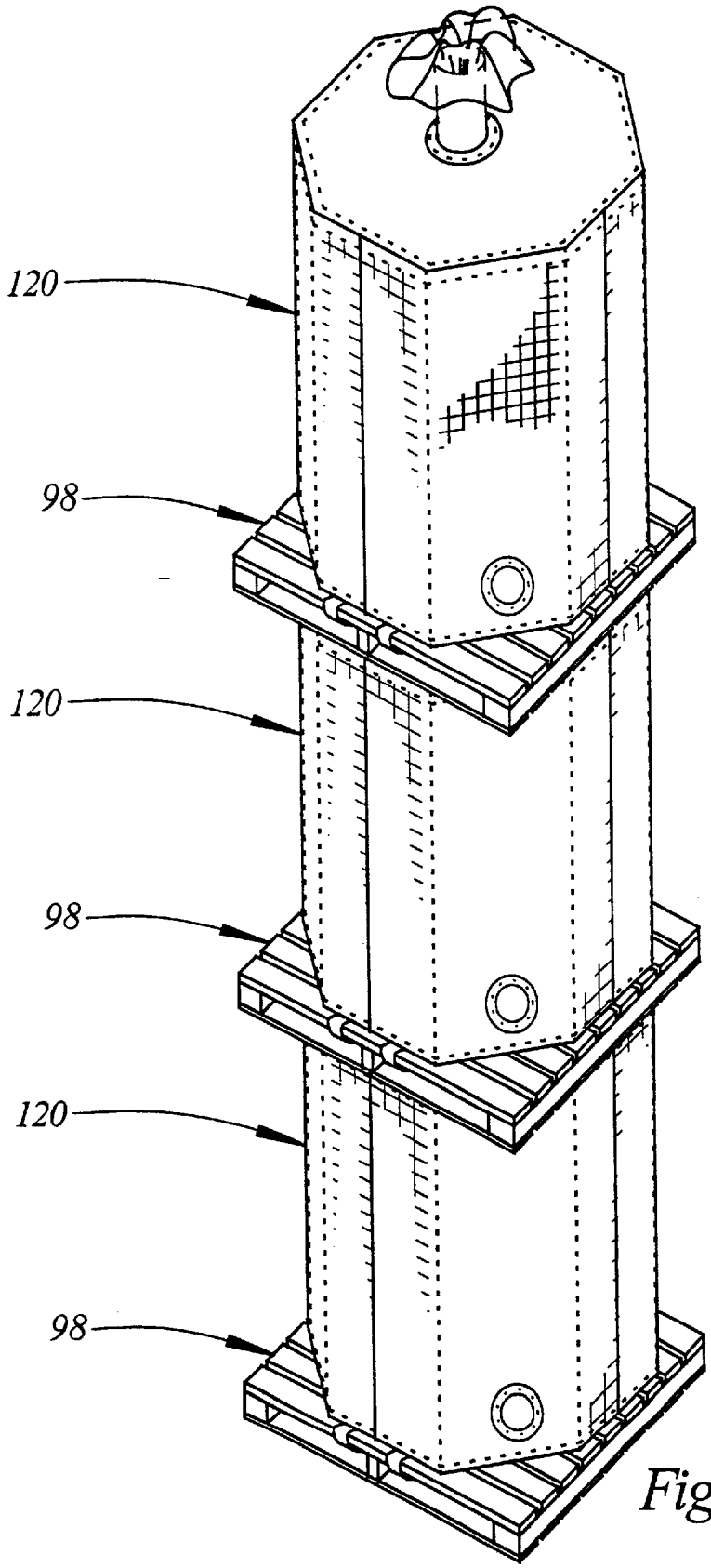
FIG. 10 is a perspective view illustrating the stacking of octagon shaped bulk bags comprising the present invention.

Referring to FIG. 10, one of the primary advantages derived from the use of the present invention comprises the fact that octagon shaped bulk bags constructed in accordance with the invention are readily adapted for stacking. FIG. 10 illustrates the bulk bag 120 of FIG. 5, however, it will be understood that the bulk bag 20 of FIG. 1, the bulk bag 140 of FIG. 7, and in fact all bulk bags incorporated in the present invention are readily adapted for stacking. FIG. 10 illustrates three bulk bags comprising the present invention stacked one on top of another, but in actual fact up to six bulk bags comprising the present invention can be stacked one on top of another depending on the density of the material contained in the bulk bags.

Figure 11:
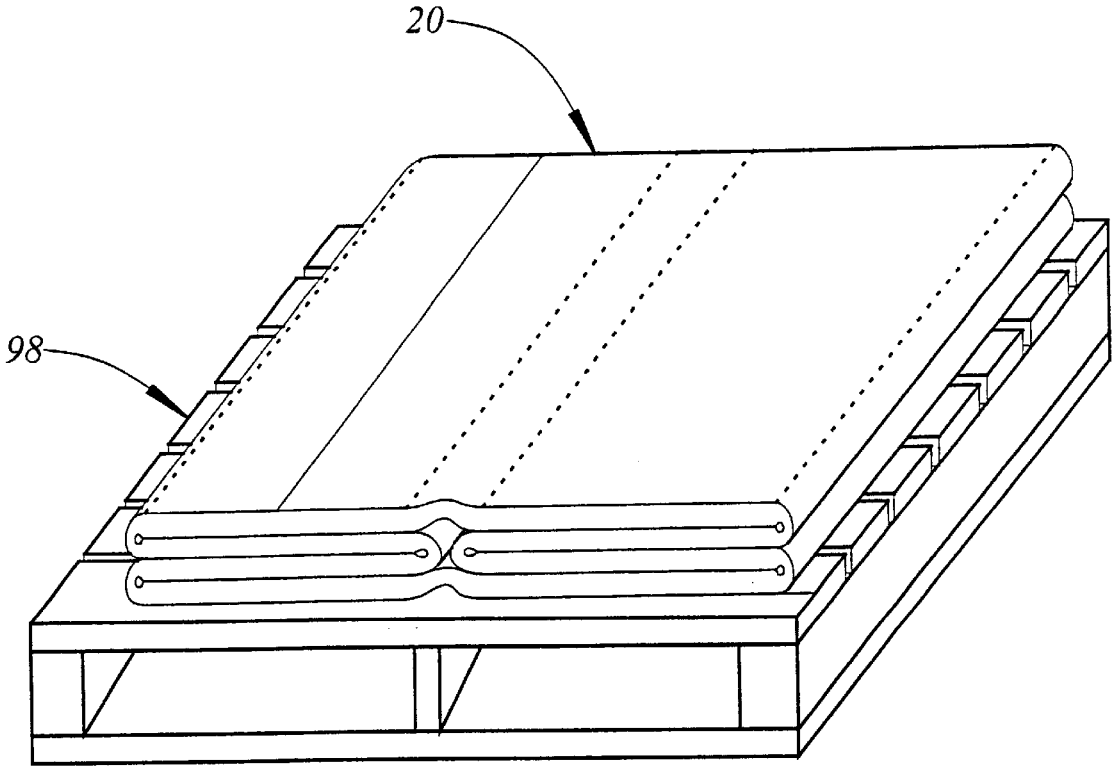
FIG. 11 is a perspective view illustrating the folding of octagon shaped bulk bags of the present invention for return shipment.

As is best shown in FIG. 11, bulk bags comprising the present invention are readily foldable for return shipment. FIG. 11 illustrates a bulk bag 20 of the type shown in FIG. 1 folded and positioned on the pallet 98 for return shipment, it being understood that the bulk bag 120 of FIG. 5, the bulk bag 140 of FIG. 7, and in fact all bulk bags incorporating the invention are adapted for folding in the manner illustrated in FIG. 11.

Figure 12:
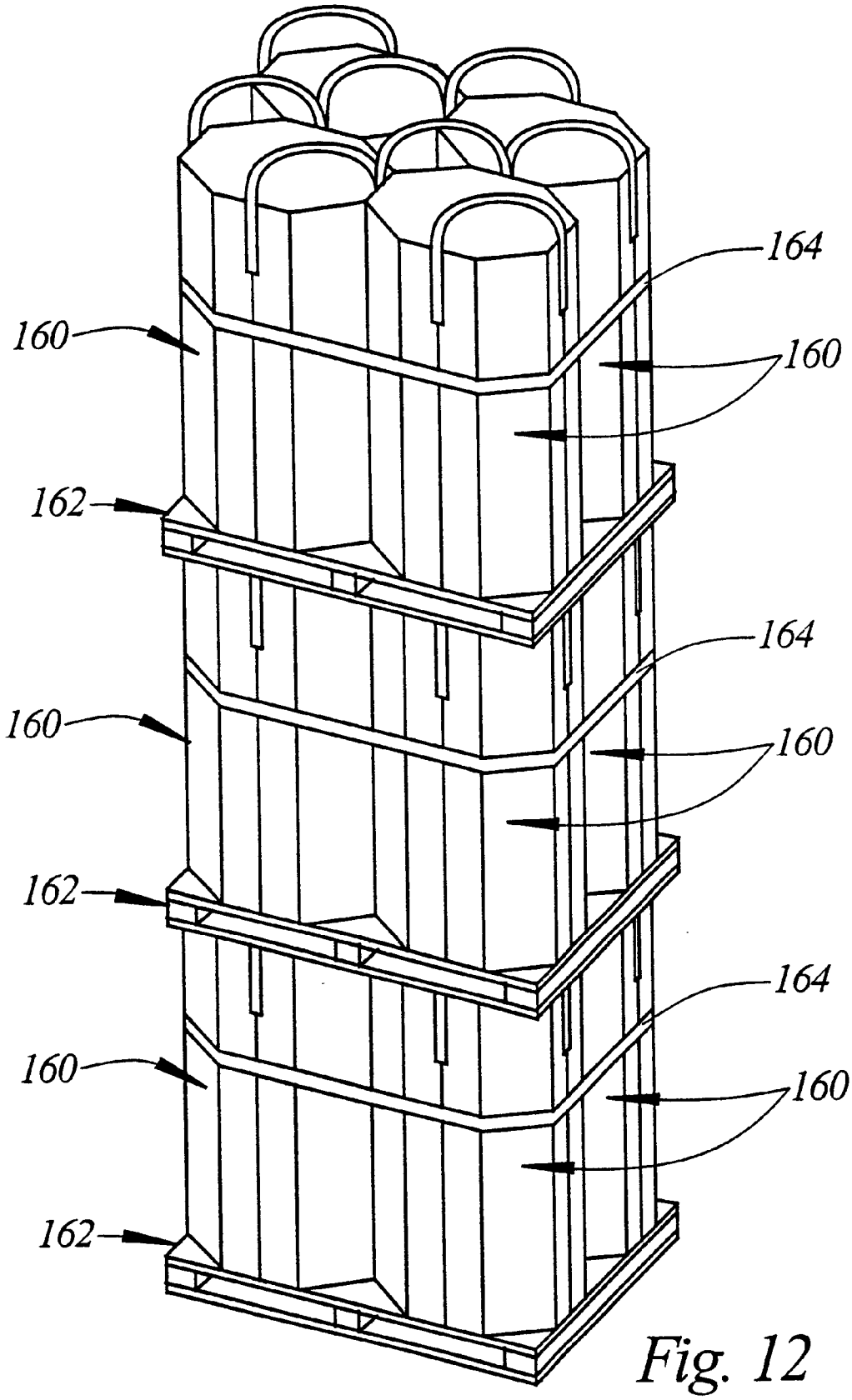
FIG. 12 is perspective view illustrating the positioning of several small size versions of the octagon shaped bulk bag of the present invention on a single pallet, and the stacking of pallets having several small size bulk bags positioned thereon.

Bulk bags comprising the present invention can be manufactured in a variety of sizes. FIG. 12 illustrates a plurality of small size bulk bags 160 incorporating the present invention. The bulk bags 160 are octagonal in shape and are otherwise substantially identical to the bulk bags of FIGS. 1–9, inclusive. As is clearly shown in FIG. 12, a plurality of small size bulk bags 160 may be received on a single pallet 162 and secured by a strap 164. The bulk bags 160 thus positioned and secured are adapted for stacking one on top of another. Up to six layers of bulk bags 160 may be stacked one on top of another depending upon the density of the material contained in the bulk bags.

The present invention further comprises a method of manufacturing octagon shaped bulk bags. In accordance with the method, there is provided eight substantially identical fabric sheets. The fabric sheets are preferably formed from woven polypropylene fabric, however, other fabric materials can be utilized in the practice of the invention. Each of the sheets is characterized by an upper edge, a lower edge, and opposed side edges.

The fabric sheets are arranged in four pairs, each pair comprising an inner layer and an outer layer. The upper, lower, and side edges of each pair are respectively aligned. The inner and outer layers comprising each pair are joined by seams extending parallel to the side edges which are spaced apart to define a side wall portion comprising a stiffening panel receiving pocket. The inner and outer layers comprising the four pairs are joined edge to edge to form four additional side wall portions, each comprising a stiffening panel receiving pocket.

The method further comprises the step of providing an octagonal shaped bottom wall. The bottom wall is preferably formed from woven polypropylene fabric, however, other materials can be used in the practice of the invention. The bottom wall is secured to the lower edges of the inner and outer layers of the side wall portions by a bottom seam which also closes the lower ends of the stiffening panel receiving pockets.

A stiffening panel is received in each stiffening panel receiving pocket. The stiffening panels preferably comprise corrugated plastic panels, however, other materials can be used in the manufacture of the stiffening panels. After the stiffening panels are installed, the upper ends of the stiffening panel receiving pockets are closed, either permanently or releaseably.

Transportation and positioning of the bulk bag and the contents thereof is facilitated either by mounting the bulk bag on a pallet or by providing the bulk bag with lift loops. The bulk bag may be provided with a top closure which may be either flexible or rigid and which may be either permanently or releaseably secured. Discharge ports may be provided either in the bottom wall or in one of the side wall portions of the bulk bag.

Although preferred embodiments of the invention have been illustrated in the accompanying drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. An octagon shaped bulk bag comprising:

eight double layer side wall portions disposed in an octagonal array and each comprising a stiffening panel receiving pocket;

alternating double layer side wall portions each comprising two half side wall portions joined by stitching;

eight stiffening panels each received in the stiffening panel receiving pocket comprising one of the side wall portions;

means for retaining the stiffening panels in the stiffening panel receiving pockets;

a bottom wall extending between and connected to the bottom of each of the side wall portions;

each of the side wall portions being charaterized by:

spaced apart vertically extending seams defining the width of the side wall portion;

a bottom seam connecting the bottom wall to the side wall portion; and a top seam;

the four seams defining the length and width of the side wall portion and comprising the means for securing the stiffening panel in the stiffening panel receiving pocket of the side wall portion;

the eight side wall portions comprising the bulk bag being substantially equal in length and width; and the eight stiffening panels which are received in the stiffening panel receiving pockets of the side portions being substantially equal in length and width.

* * * * *